US007415738B2

(12) United States Patent
Weedling et al.

(10) Patent No.: US 7,415,738 B2
(45) Date of Patent: Aug. 26, 2008

(54) PATIENT TRANSFER MATTRESS HAVING CONNECTABLE SEGMENTS

(75) Inventors: Robert E. Weedling, Center Valley, PA (US); James E. Weedling, Center Valley, PA (US)

(73) Assignee: Patient Transfer Systems, Inc., Center Valley, PA (US)

( * ) Notice: Subject to any disclaimer, the term of this patent is extended or adjusted under 35 U.S.C. 154(b) by 159 days.

(21) Appl. No.: 11/488,988

(22) Filed: Jul. 19, 2006

(65) Prior Publication Data

US 2006/0253976 A1 Nov. 16, 2006

Related U.S. Application Data

(63) Continuation of application No. 10/936,050, filed on Sep. 8, 2004, now abandoned, which is a continuation-in-part of application No. 10/143,139, filed on May 10, 2002.

(60) Provisional application No. 60/290,413, filed on May 11, 2001.

(51) Int. Cl.
*A61G 7/10* (2006.01)

(52) U.S. Cl. ..... 5/81.1 R; 5/710

(58) Field of Classification Search ..... 5/81.1 R, 5/710, 713; 180/125; 414/676; 406/86
See application file for complete search history.

(56) References Cited

U.S. PATENT DOCUMENTS

| | | | | |
|---|---|---|---|---|
| 4,528,704 | A | 7/1985 | Wegener et al. | 5/81 R |
| 4,627,426 | A | 12/1986 | Wegener et al. | 128/132 R |
| 4,631,767 | A | 12/1986 | Carr et al. | 5/449 |
| 4,686,719 | A * | 8/1987 | Johnson et al. | 5/81.1 R |
| 5,065,464 | A | 11/1991 | Blanchard et al. | 5/81 R |
| 5,117,519 | A * | 6/1992 | Thomas | 5/500 |
| 5,168,589 | A | 12/1992 | Stroh et al. | 5/710 |
| 5,249,318 | A * | 10/1993 | Loadsman | 5/710 |
| 5,448,790 | A | 9/1995 | Saro et al. | 5/657 |
| RE35,299 | E | 7/1996 | Weedling et al. | 5/81.1 T |
| 5,561,873 | A | 10/1996 | Weedling | 5/711 |
| 5,566,409 | A | 10/1996 | Klearman | 5/723 |
| 6,073,291 | A | 6/2000 | Davis | 5/711 |
| 6,240,584 | B1 | 6/2001 | Perez et al. | 5/713 |
| 2001/0023512 | A1 | 9/2001 | Perez et al. | 5/713 |

* cited by examiner

*Primary Examiner*—Fredrick Conley
(74) *Attorney, Agent, or Firm*—Drinker Biddle & Reath LLP

(57) ABSTRACT

A patient transfer mattress includes a plurality of inflatable segments each including holes in a bottom sheet to create a cushion of escaping air beneath the segment to facilitate sliding of the segment along an underlying surface. The segments include attachment members, such as snaps, belts or hook and loop fasteners, adjacent peripheral edges of the segments, for connecting the inflatable segments to each other. The segments may also include fasteners for attachment of an accessory across an upper surface of the segment. Preferably, the mattress segments also include corner straps for engagement with a mattress support member to limit relative movement between the transfer mattress and the mattress support member.

13 Claims, 12 Drawing Sheets

PATIENT TRANSFER MATTRESS HAVING CONNECTABLE SEGMENTS

CROSS-REFERENCE TO RELATED APPLICATIONS

This is a continuation of application Ser. No. 10/936,050, filed Sep. 8, 2004 now abandoned, which is a continuation-in-part of co-pending application Ser. No. 10/143,139, filed May 10, 2002, which claims priority from U.S. provisional application No. 60/290,413, filed May 11, 2001.

FIELD OF THE INVENTION

The present invention relates generally to inflatable air mattresses used for medical purposes. More particularly, the present invention relates to an inflatable patient transfer mattress including small holes in a bottom sheet to form a cushion of air beneath the mattress to facilitate sliding of the mattress along an underlying support surface.

BACKGROUND OF THE INVENTION

The most prevalently produced transfer mattresses at the current time have an array of laterally extending chambers arranged in a generally rectangular pattern in the center of the mattress, with a continuous, rectangular outer chamber extending around the periphery of the mattress. Several embodiments of this type are shown in U.S. Pat. No. 5,561,873. The top sheet of these transfer mattresses is usually a twill weave nylon fabric coated on one side with urethane to make it vapor permeable but waterproof.

Although these mattresses can be cleaned and disinfected after use with various germicidal cleaning solutions, it is preferable to keep the mattress surfaces protected from contact with infectious or contaminating body fluids. This has been accomplished in prior art air mattresses by providing a sanitary sheet, essentially identical to the top sheet of the mattress, which is folded and inserted in a pouch at the foot end of the mattress. This sheet, referred to as a "sani-liner", is intended to be removed from the pouch and laid over the top sheet of the deflated mattress before the patient is placed upon the mattress. When the mattress is then inflated, the sani-liner sheet protects the top surface of the mattress from potentially infectious material. The sani-liner can later be cleaned and disinfected, folded and returned to the pouch.

In practice, however, when hospital workers sometimes need to use the transfer mattress quickly, they do not always take time to remove the sani-liner from the pouch and cover the top sheet. Furthermore, when the sani-liner is removed or otherwise comes detached, it is often lost and not replaced. Thus, it would helpful to have a removable sanitary cover that is already in place over the top sheet when the mattress is deflated and stored, and that can be removed and cleaned or replaced with another cover after use. Consistent with the above, it would be useful to have a transfer mattress that includes fasteners for attaching various accessories, including sanitary covers, to the mattress.

It would also be useful to have a sectional air mattress comprising at least one inflatable transfer pad, with accessories to facilitate convenient repositioning of a patient in a bed, or to improve the ease of transferring a patient from a bed to a chair and vice versa.

SUMMARY OF THE INVENTION

According to the present invention, a patient transfer mattress includes a plurality of inflatable mattress segments. Each of the mattress segments includes a plurality of small holes in a bottom sheet to create a cushion of escaping air beneath the mattress segment that facilitates sliding movement of the mattress segment along an underlying surface. Each of the mattress segments also includes at least one attachment member, preferably located adjacent to a peripheral edge of the mattress adapted for engagement with an attachment member of another mattress segment for attaching the segments to each other. According to presently preferred embodiments, the attachment members may be snaps, belts or hook and loop fasteners.

According to one embodiment, each of the inflatable mattress segments also includes fasteners for attaching an accessory across an upper surface of the mattress segment.

According to one embodiment, at least one of the inflatable mattress segments includes corner straps adapted for engagement with a mattress support member to limit relative movement between the patient transfer mattress and the mattress support member. The corner straps extend between one of the ends of the mattress segment and the opposite sides of the mattress segment such that the corner straps are located at adjacent corners of the mattress segment. Preferably, the corner straps are elastic and located on a bottom surface of the mattress to facilitate engagement between the corner straps and the mattress support member.

BRIEF DESCRIPTION OF THE DRAWINGS

For the purpose of illustrating the invention, there is shown in the drawings a form which is presently preferred; it being understood, however, that this invention is not limited to the precise arrangements shown.

DETAILED DESCRIPTION OF THE DRAWINGS

Figure 1:
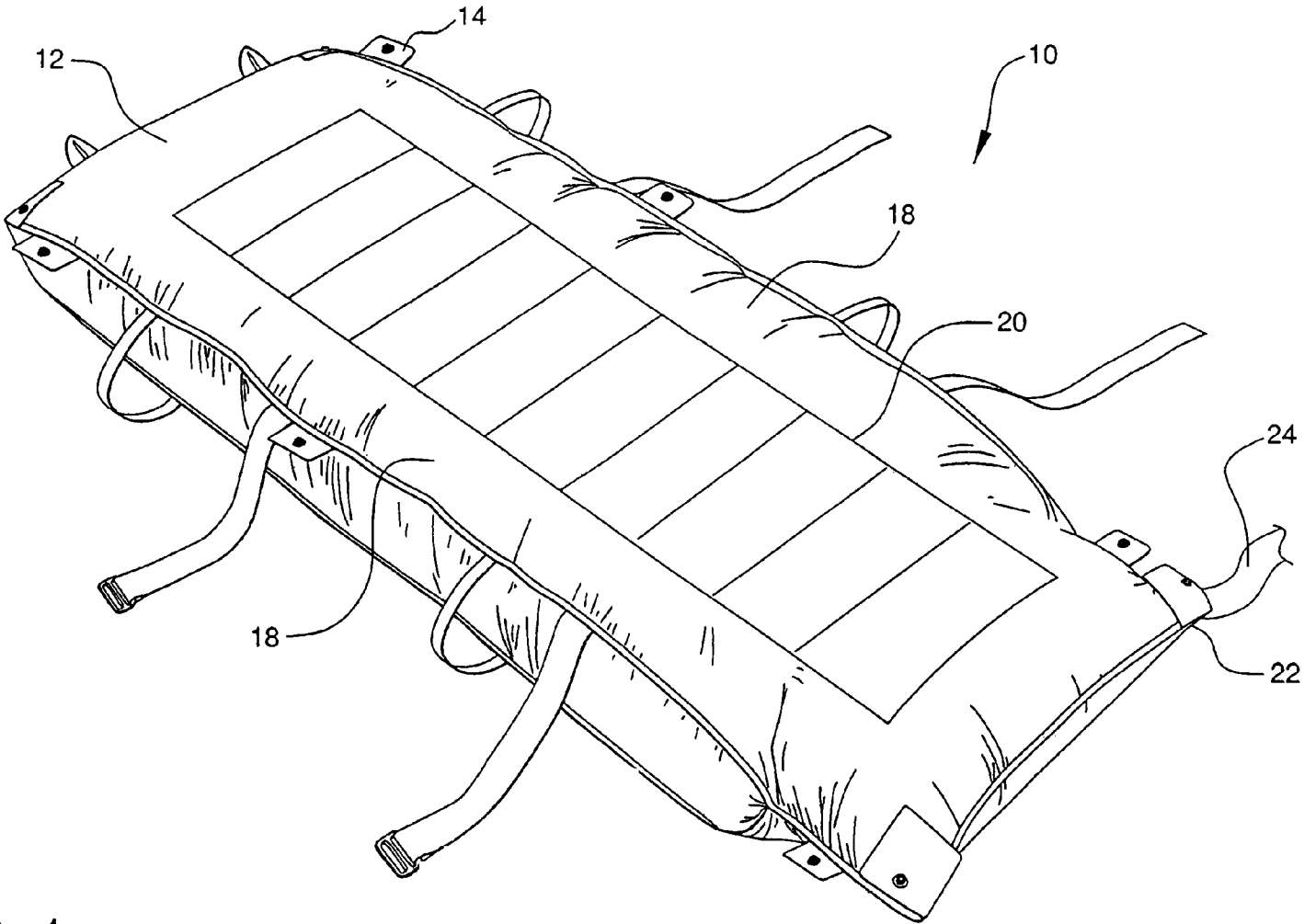
FIG. 1 is a perspective view of a patient transfer device, in accordance with an embodiment of the invention.

Referring now to the figures, there is shown in FIG. 1 one embodiment of patient transfer device 10. The patient transfer device 10 comprises at least one transfer mattress 12 and a plurality of fasteners 14 for attaching an accessory across a top surface of the mattress 12. The mattress 12 may include a generally rectangular array of transverse air chambers 16 supported at each longitudinal side thereof by a longitudinally-extending side air chamber 18. The transition between the transverse chambers 16 and side chambers 18 defining a seam 20 at each longitudinal side of the array.

The fasteners may be any type of fastener capable of attaching an accessory to the mattress 12 and the type of fastener may vary depending on the type of accessory. The fasteners may also be located anywhere on the mattress 12 or attached to the mattress 12 in any manner suitable in light of the accessory. In the embodiment depicted in FIG. 1, the fasteners are mounted on tabs attached to the longitudinally-extending side air chambers.

In FIG. 1, an inlet 22 for inflating the mattress 12 may be a closable opening wherein an air supply hose 24 is inserted and the inlet is snapped shut or otherwise closed to hold the hose in place while the mattress is being inflated. The inlet 22 may also include a valve biased to be normally closed to prevent air from exiting through the inlet and opened when the hose 24 is inserted into the inlet 22. Other arrangements known to those skilled in the art may be used to inflate the mattress 12.

The various types of accessories that may be attached to a transfer mattress are generally unlimited. By way of example, some preferred accessories include various types of covers, such as a non-absorbent sanitary cover, a washable absorbent cover or a disposable cover. Another useful accessory is a flexible body litter with carry handles. Other possible accessories include a wrap for wrapping around a patient or a garment worn by the patient to assist in moving the patient together with the transfer device; a cushion; an inflatable air mattress with a pressure control valve; an inflatable air mattress with pulsating pressure control; a non-inflatable mattress; and a therapeutic pad.

In an embodiment where the selected accessory is a cushion, the cushion may be releasably attached to the inflatable mattress or the cushion and mattress may be constructed as a single unit.

In embodiments where there is an inflatable air mattress, a top surface of the inflatable mattress may be inclined so that the head of a patient lying horizontally on the mattress is at a higher point with respect to a supporting surface than the feet.

Figure 2:
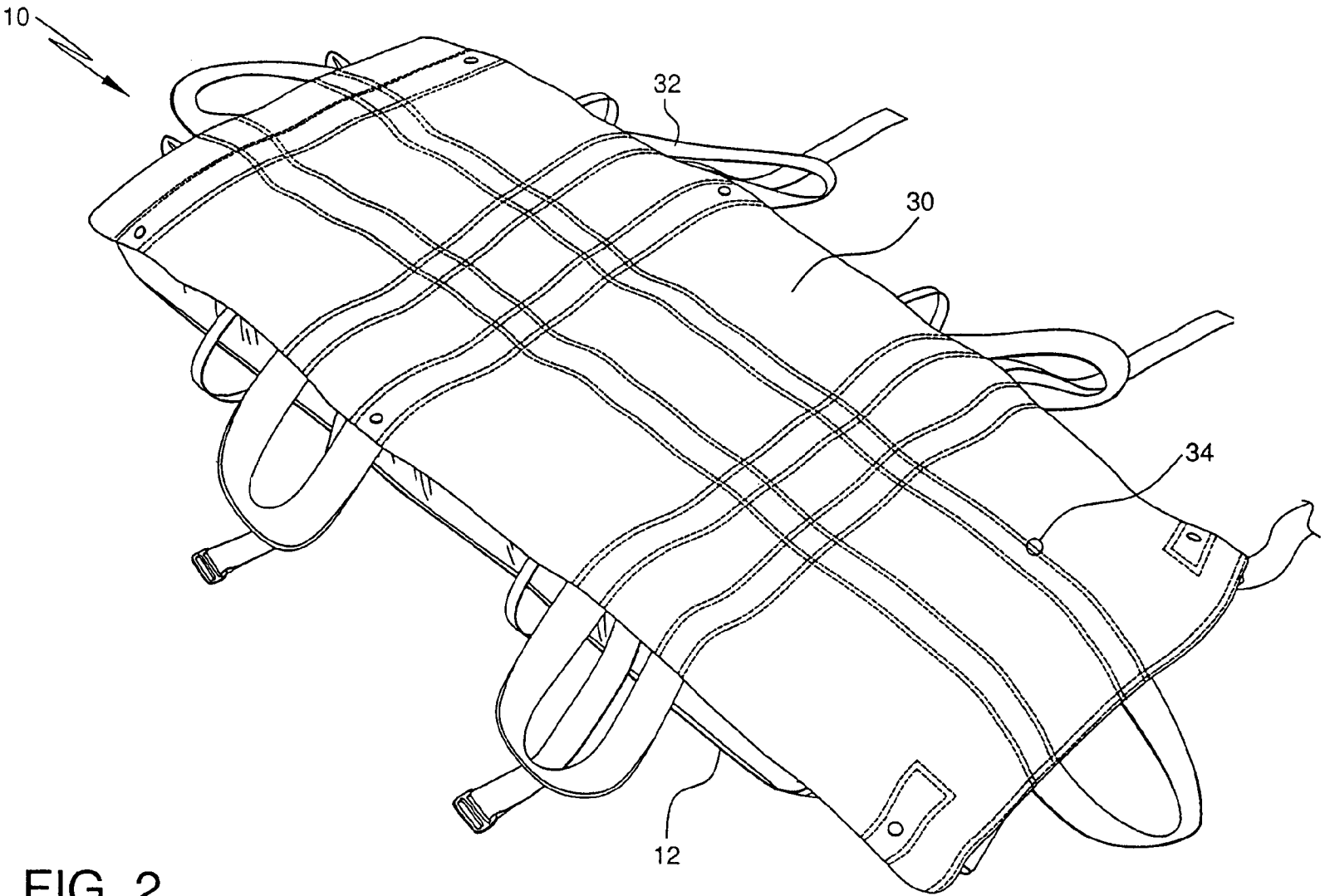
FIG. 2 is a perspective view of a patient transfer device comprising a body litter attached to a top surface of a transfer mattress adapted for transferring a patient from one surface to another, in accordance with an embodiment of the invention.

Referring now to FIG. 2, the patient transfer device 10 is shown with an accessory attached. The accessory is a body litter 30 having carry handles 32. The carry handles are a loop of fabric sewn to the litter 30 as shown by the stitching 34 running between each pair of handles 32. The loop is preferably continuous as shown. In a preferred embodiment, at least two pair of carry-handles extend outward from the mattress. In the depicted embodiment, there are three pairs of carry handles 32, two at the sides and one at each end.

Figure 2A:
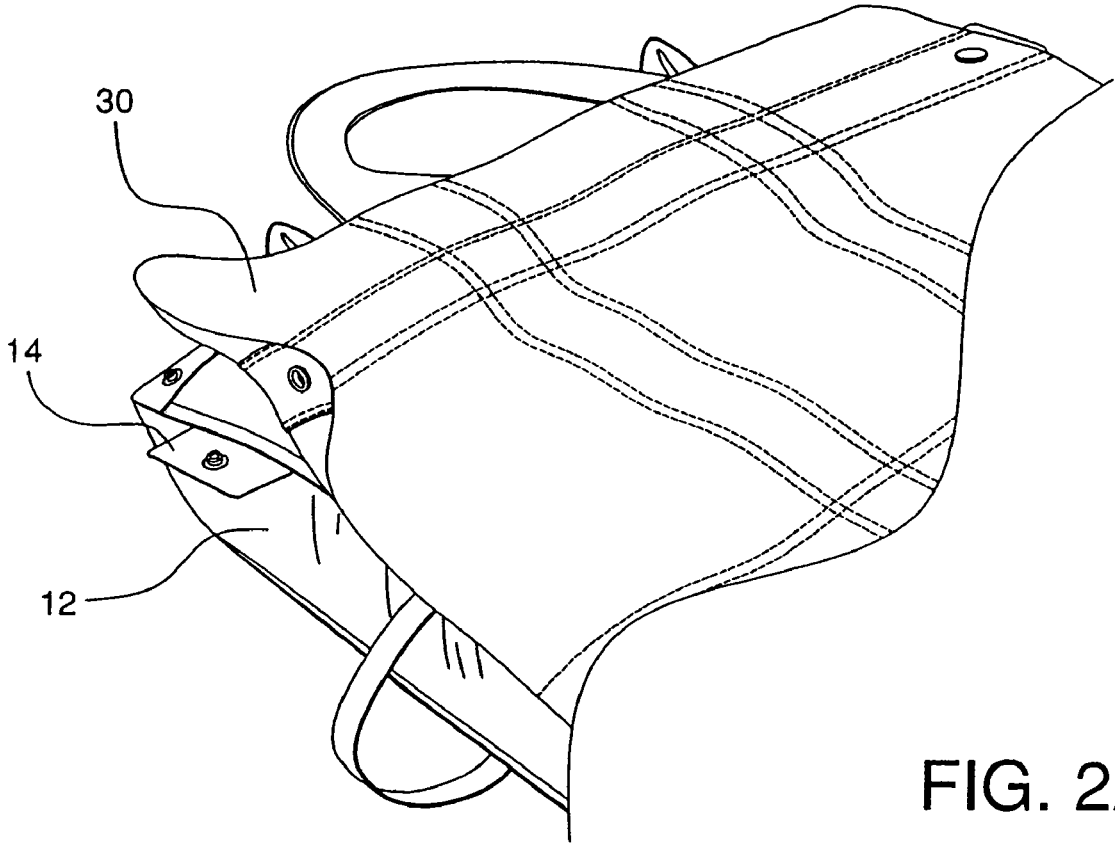
FIG. 2A is a partial view of the patient transfer device shown in FIG. 2 wherein at a corner of the device the body litter is partially removed, in accordance with an embodiment of the invention.

The body litter 30, or any other accessory, may be attached to the transfer mattress 12 using any type of fastener or suitable means of fastening. The selected accessory and mattress may alternatively be fixedly attached or otherwise constructed as a single unit. In FIG. 2A, the fastener is a snap fastener. As shown in FIG. 2A, the tabs 14 have snaps which can attach to snaps located at corresponding positions on the body litter 30, or any accessory. The fasteners 14 may be located outboard of the seams defined by the transition between the transverse chambers and the side chambers. The fasteners may also be mounted on tabs attached to the longitudinally-extending side air chambers, as shown in FIG. 1.

Figure 2B:
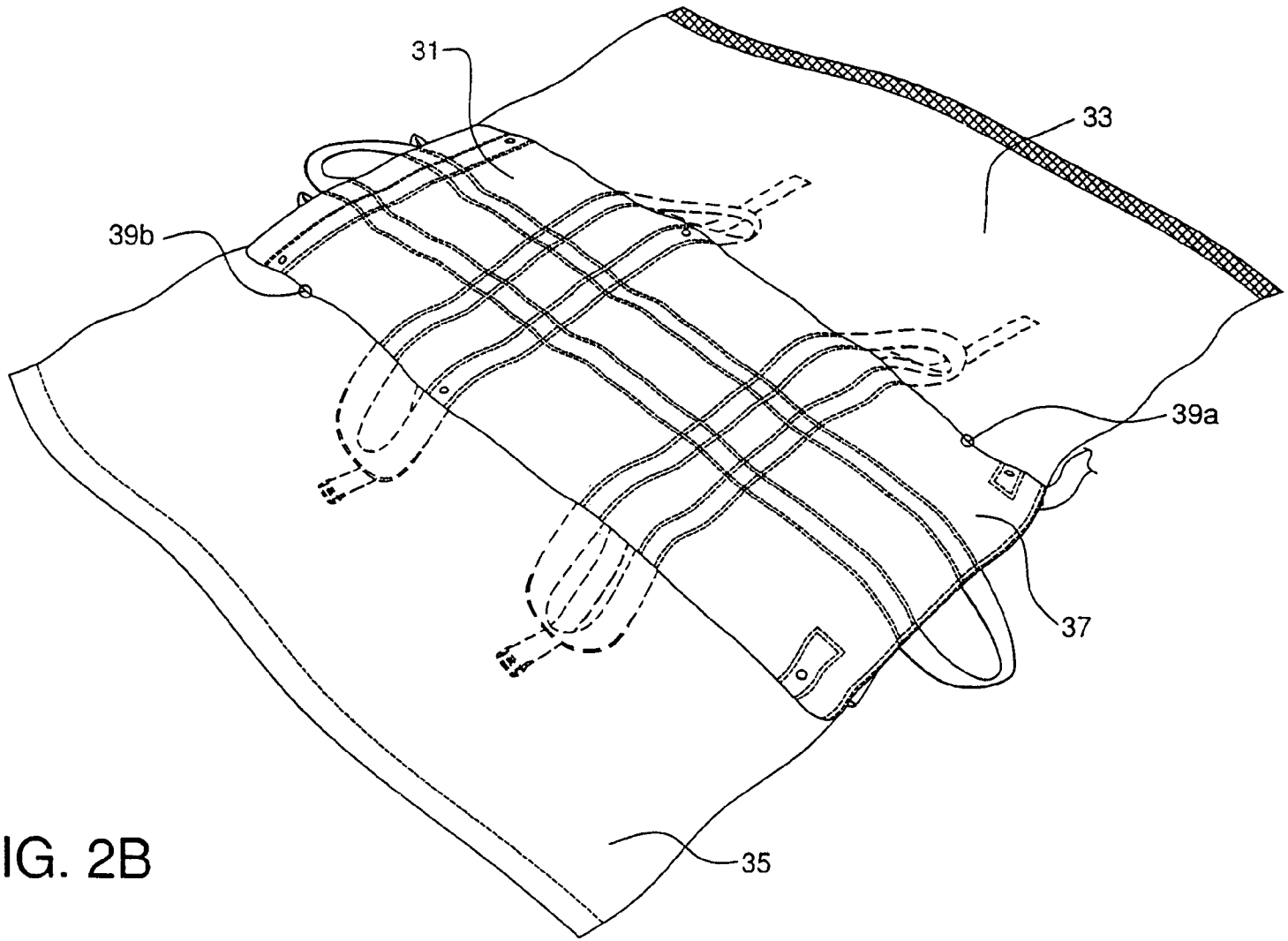
FIG. 2B is a perspective view of a patient transfer device comprising a body litter having flaps, in accordance with an embodiment of the invention.

A preferred body litter 31 is shown in FIG. 2B. The body litter 31 depicted in FIG. 2B includes flaps 33, 35 that extend outward from each side of the body litter 31. When not in use, flap 33 may be folded over the litter's center panel 37 along line 39*a*. Similarly, flap 35 may be folded over the litter's center panel along line 39*b*. If a patient laying on the transfer device is pronounced dead or if a body needs to be transferred, the flaps 33, 35 may be opened as shown in FIG. 2B allowing the body to be covered and transported using one or more pair of carry handles that are preferably attached to the litter's center panel 37. The flaps 33, 35 may also be thermally coated and used to warm patients in shock or who otherwise need to be warmed.

Figure 3:
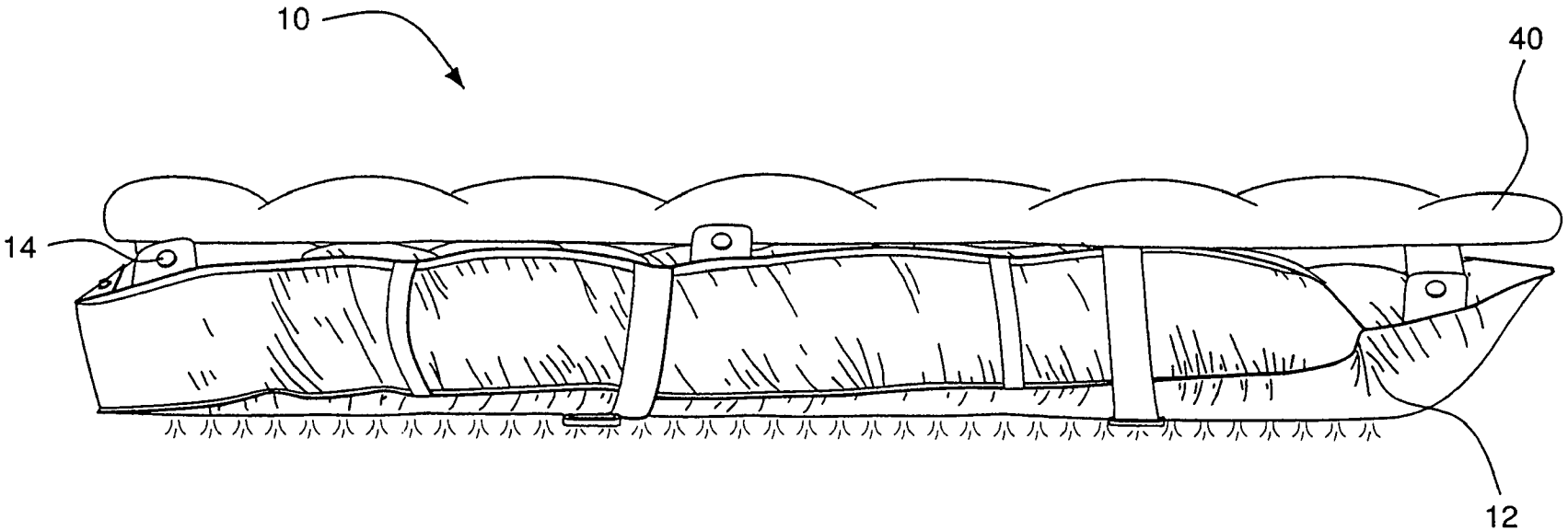
FIG. 3 is an elevation view of a patient transfer device comprising a transfer mattress adapted for transferring a patient from one surface to another with an inflatable mattress attached to the transfer mattress, in accordance with an embodiment of the invention.

In a transfer device, the transfer mattress has a bottom sheet with a pattern of tiny holes to allow the escape of air supplied into the mattress by a low-pressure air supply. The air supplied to the transfer mattress escapes through the holes, providing a weight-bearing cushion to facilitate sliding the mattress along a surface as well as from one surface to another. In FIG. 3, an embodiment is shown in which the accessory is an inflatable mattress 40, which may have a pressure control valve or pulsating pressure control. The inflatable mattress 40 may include a top surface that is inclined so that the head of a patient lying horizontally on the mattress is at a higher point with respect to a supporting surface than the feet. The mattresses 12, 40 may be releasably attached as shown with snaps. The mattresses 12, 40 may also include at least one sheet, either top or bottom or both, that is rigid or substantially rigid to cause a surface to remain relatively level while the mattress is inflated.

In the embodiment shown in FIG. 3, it should be understood that the second mattress 40 is not limited to being an air mattress, but may be any type of mattress or pad depending on the needs of the patient. For instance, it is very common for closure of a patient's capillaries to be a concern for patients that are confined to a bed for an extended period. In such situations, any type of accessory that will prevent capillary closure may be attached to the transfer mattress 12. For example, any type of therapeutic pad, such as for example a gel pad, may be attached to the transfer mattress 12 to ensure patient comfort and reduce the risk of capillary closure. Where the mattress 40 is inflatable, however, a variable pressure air supply may be used so appropriate pressure levels may be delivered to each mattress, as desired. For example, the inflatable mattress 40 may be inflated using a lower degree of pressure than the transfer mattress 12.

The transfer and inflatable mattresses may be constructed in any shape or size. For example, the transfer mattress may be constructed so that the apex distance between top and bottom sheets, when the pads are inflated, is greater outboard of the seam than in the array of transverse chambers to bias the patient towards the center of the pad by creating the effect of an inverted pontoon at each longitudinal side of the array.

Figure 4:
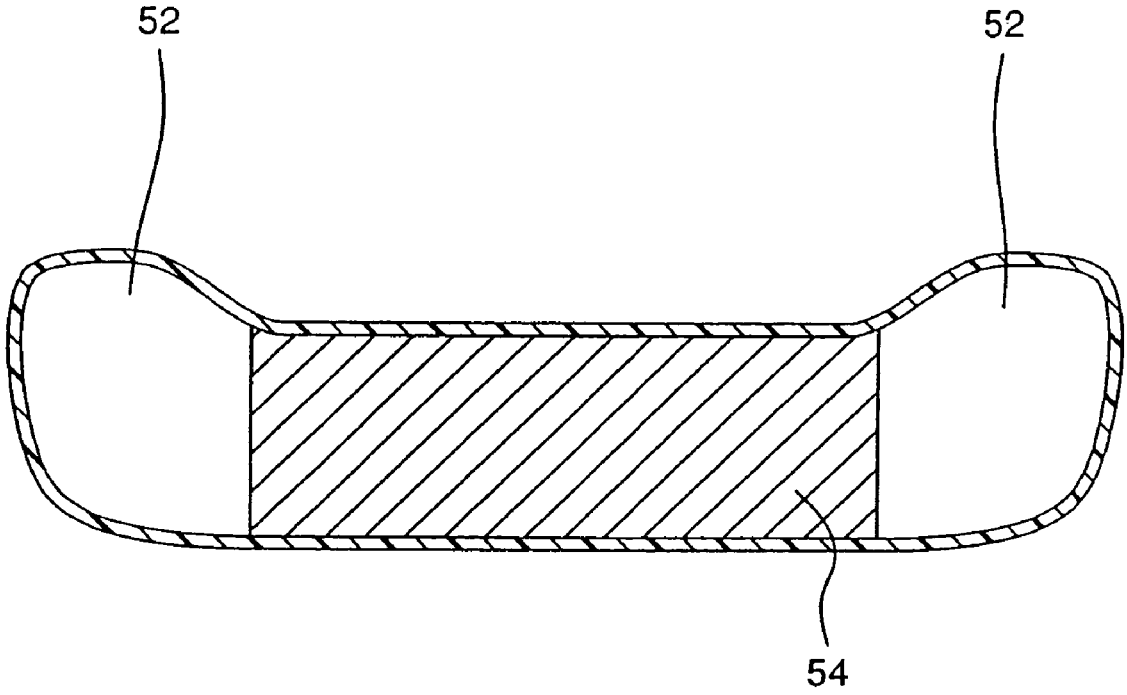
FIG. 4 is a cross-sectional view of a patient transfer device wherein a transfer mattress is adapted to assist in centrally locating a patient on the mattress and showing an interior partition to prevent the mattress from hot-dogging, in accordance with an embodiment of the invention.

FIG. 4 shows a cross-sectional view of a transfer mattress or pad constructed in that shape. This shape is especially useful for helping to center a patient on the mattress and providing additional security for the patient. The transfer mattress can also be constructed such that the plenum chamber 52 of the pontoon extend downward. Adjusting the distance of transverse partition members between top and bottom sheets causes variations in the shape of a mattress. To adjust the distance between sheets, the height of the partition 54 may be adjusted, as desired.

Figure 5:
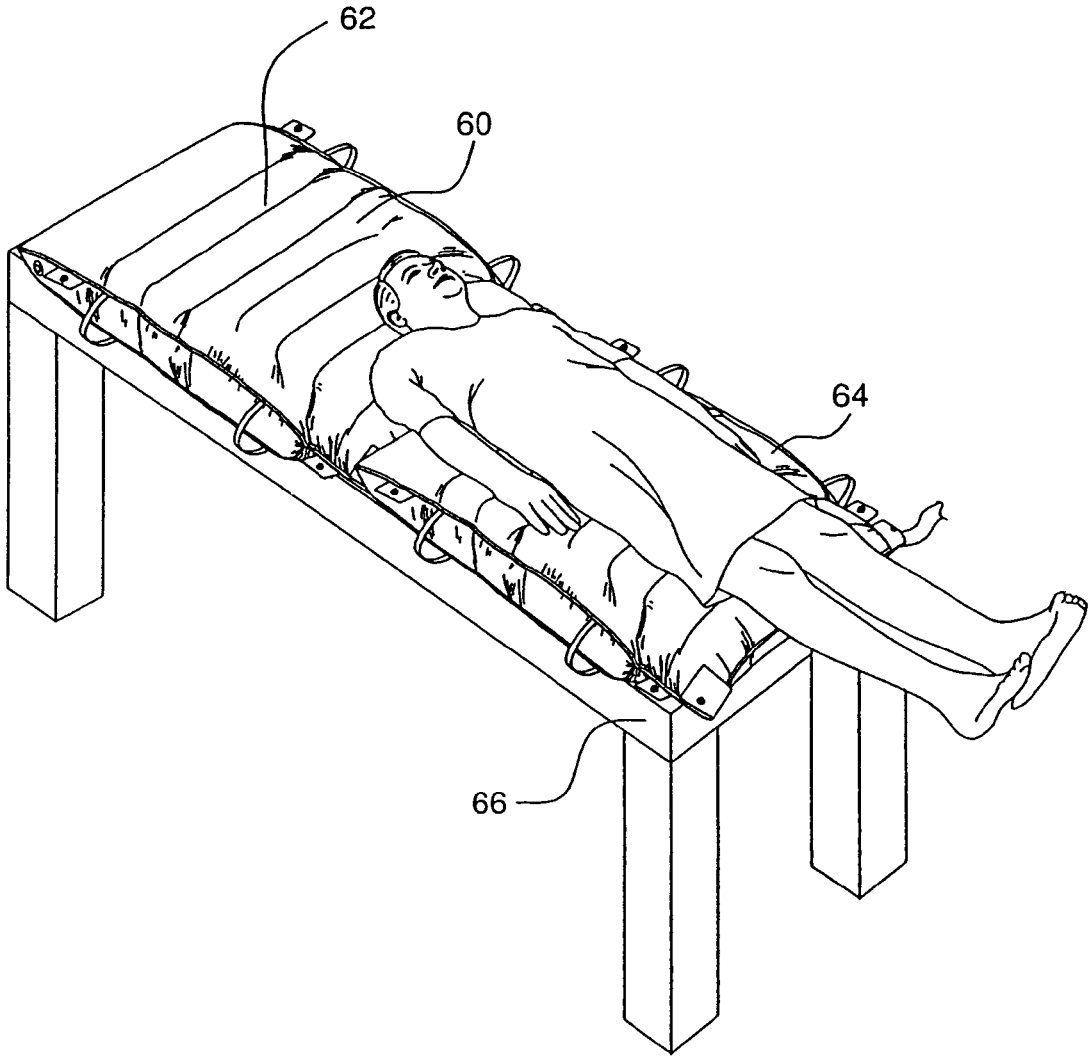
FIGS. 5 and 6 are a patient transfer device comprising a sectioned mattress formed with two inflatable pads, in accordance with an embodiment of the invention.
Figure 6:
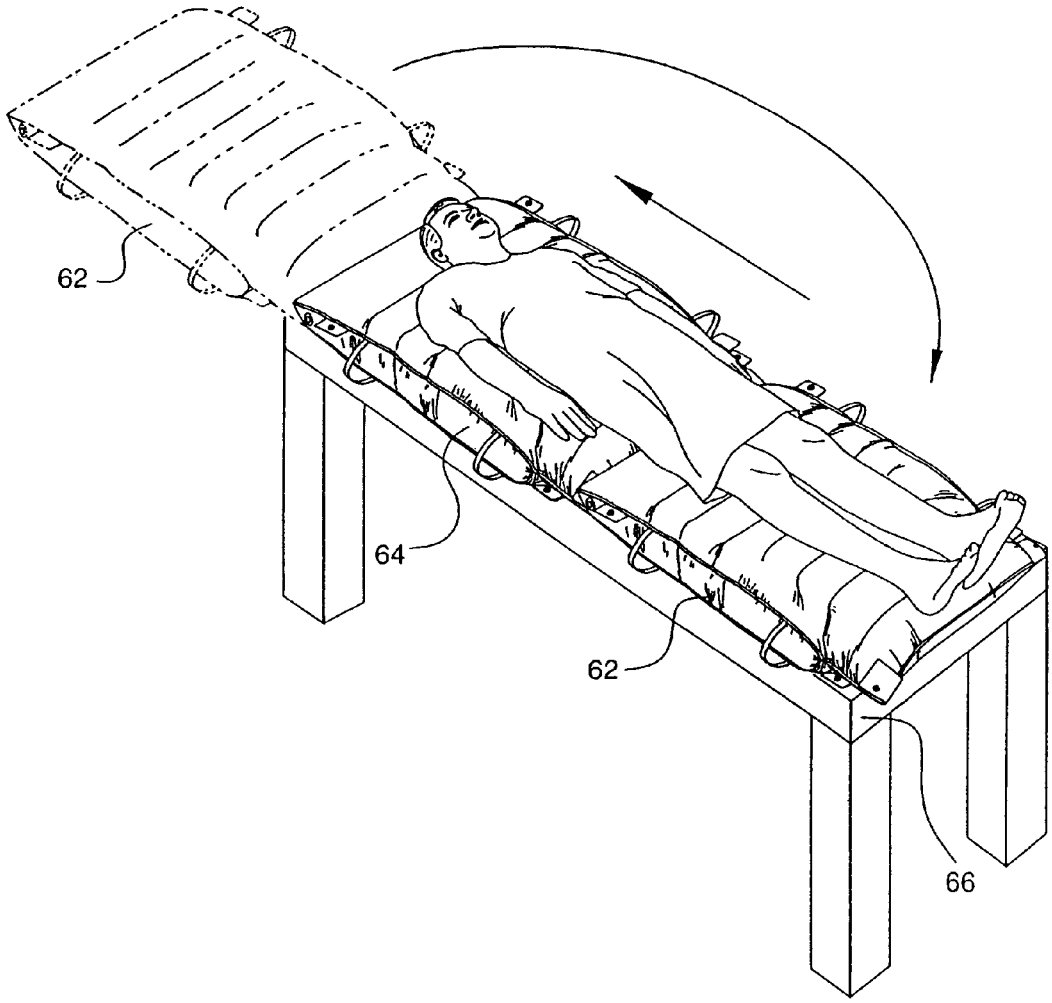

Moving to FIGS. 5 and 6, an embodiment of the patient transfer device may include a sectional mattress 60 having a plurality of inflatable pads 62, 64, at least one being a transfer pad having a bottom sheet with a pattern of tiny holes to allow the escape of air to facilitate sliding the pad from one surface to another. In this embodiment, each pad may have means for attaching to another pad to form a complete mattress 60 for a patient. The attachment means may be a snap, belt, or hook and loop fastener, for example. There may be any number of pads but the overall collective size of the pads when attached together will generally be similar in size to a typical hospital bed. In FIG. 5, the sectioned mattress 60 is shown as comprising two inflatable pads 62, 64, each less than about half the size of a typical hospital bed. The embodiment is useful because a patient laying on a hospital bed 66 will often slide down toward the foot end of the bed. In such situations, staff members typically physically pull the patient back towards the headboard. This process is often painful for the patient and a major cause of muscular skeletal disability for staff members. Having a sectioned inflatable mattress 60 comprising one or more inflatable pads 62, 64 as shown in FIG. 5 allows the patient to be repositioned more effectively and safely, as described below.

In FIG. 5, the patient is shown partially slid downward on a hospital bed 66. The sectioned mattress 60 of the present invention is between the bed 66 and the patient. The patient can be repositioned slightly so that his upper body will be completely supported by the lower inflatable pad 64 once it is inflated. (Note, the more pads used to form the mattress 60, the less likely the patient will have to be repositioned prior to inflating the pads.)

Once the patient is in-place on pad 64, the top pad 62 may be removed. The pad 64 supporting the patient's torso is then inflated and slid upward so the patient is again properly positioned in the bed. The pad 62 is then reattached at the bottom of pad 64. The process may be repeated as necessary. Alternatively, if appropriate, after the top pad 62 is removed, it may be reattached and then inflated so that both pads 62 and 64 are used to reposition the patient as desired. Of course, the pads 62, 64 may also be inflated to move the patient from the bed to another supporting surface.

The embodiment of the invention shown in FIGS. 5 and 6 and described above, may, like other embodiments, include fasteners for attaching any type of accessory, as desired. More specifically, each pad may further include a plurality of fasteners for attaching an accessory across a top surface of a sectioned mattress formed by pads 62, 64 being attached together. The pads also include fasteners for attaching one pad to another pad and may be located on tabs that are attached to the pads at various locations, as desired.

The pads 62, 64 may include a top sheet and a bottom sheet, the top and bottom sheets being attached to each other by internal fabric strips forming a generally rectangular array of transverse air chambers supported at each longitudinal side thereof by a longitudinally-extending side air chamber. In such cases, the fasteners may generally be located outboard of the seams defined by the transition between the transverse chambers and the side chambers.

A transfer mattress, inflatable mattress, sectioned mattress, and inflatable pads, may be constructed to keep a patient level with respect to a supporting surface. When a patient is laying horizontally, the patient's torso typically imposes the greatest load on a mattress. This is of particular significance for air mattresses. If an air mattress is not constructed to properly support the patient's torso with respect to his feet and head, a patient may be forced to lay on the mattress with his feet and/or head above his torso, which is uncomfortable and could result in potentially harmful spinal flex. Therefore, it is desirable to construct the interior of an air mattress similar to what is shown in U.S. Pat. No. 5,561,873. In the '873 patent, the interior of an air mattress is constructed so that the amount of air pressure provided at various parts of the mattress correspond to the load to keep the patent substantially horizontal with respect to an underlying surface.

Figure 7A:
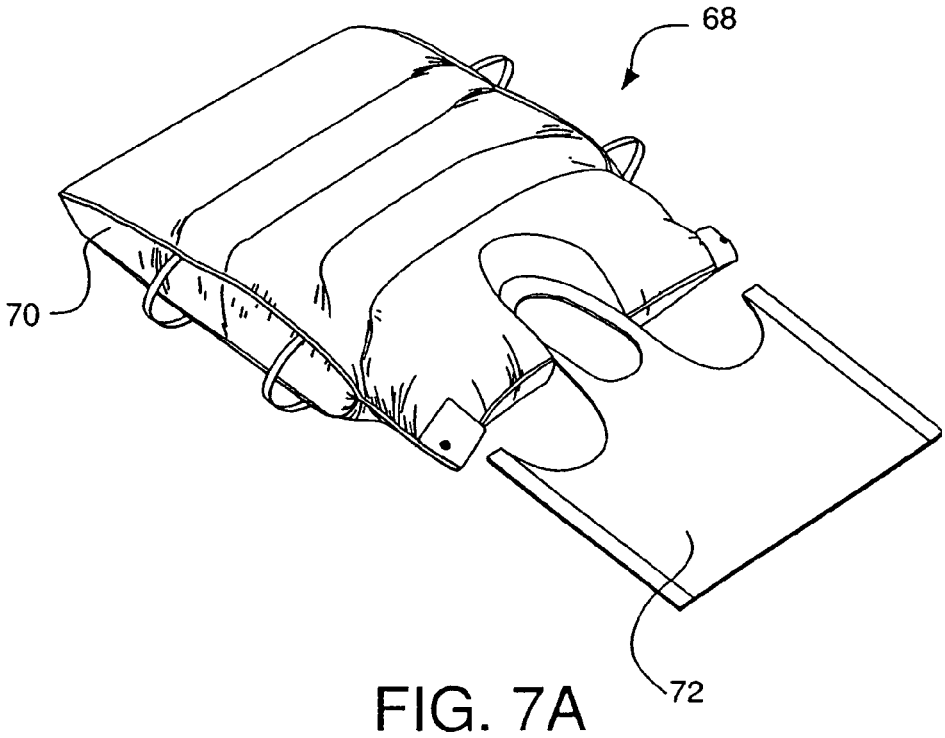
FIGS. 7A and 7B are a wearable patient transfer device comprising a transfer mattress and a garment, in accordance with an embodiment of the invention.
Figure 7B:
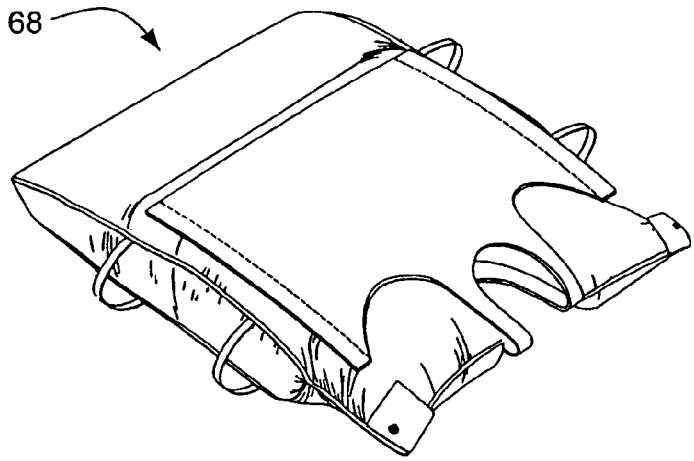
Figure 8:
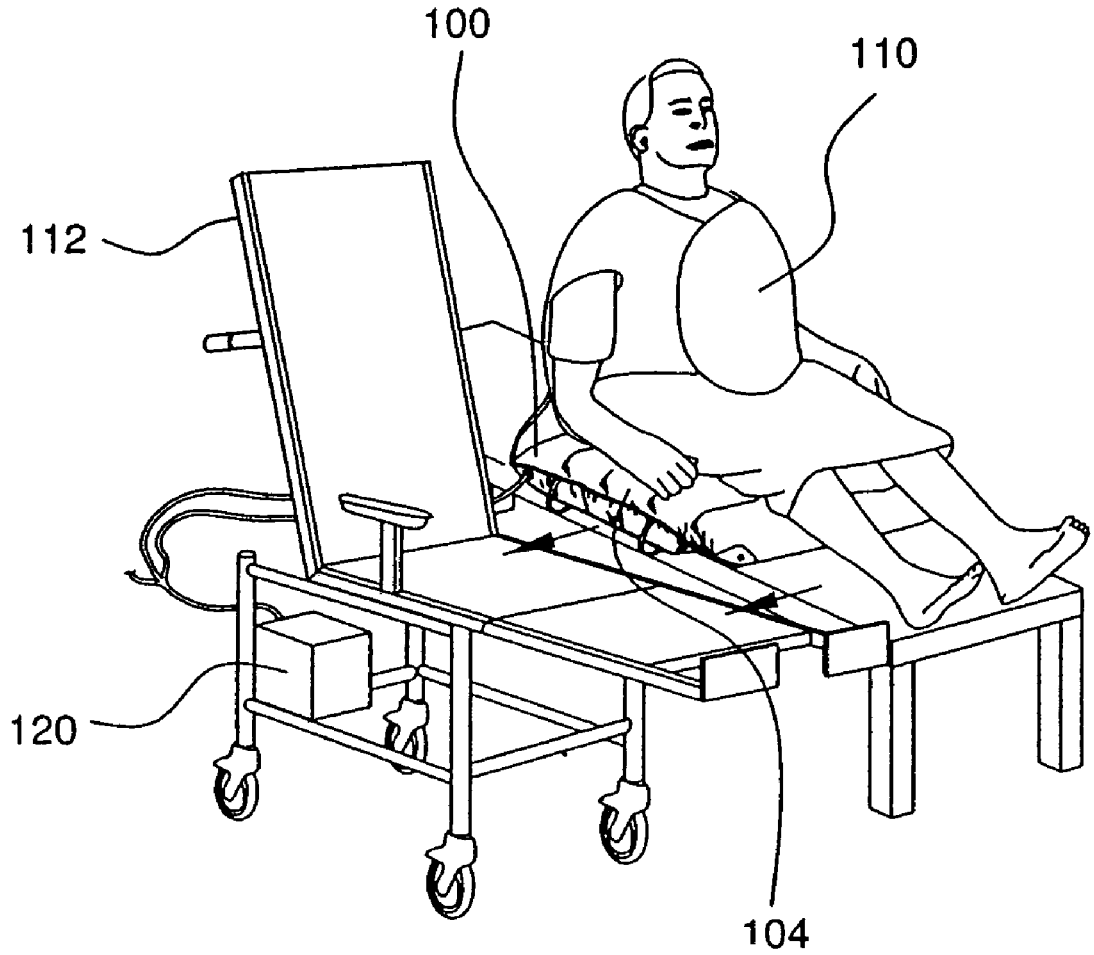
FIG. 8 is a wearable patient transfer device comprising a transfer mattress and a vest, in accordance with an embodiment of the invention.

Referring now to FIGS. 7A, 7B, and 8, embodiments of a patient transfer device 68 that patients can be attached to or worn by a patient are shown. In FIGS. 7A and 7B, the patient transfer device 68 comprises a transfer mattress 70 having a body garment 72 which allows the device 68 to be worn like a pair of shorts. The garment 72 may be any accessory capable of causing the patient to move together with the mattress 70. By way of example, a suitable accessory 68 may be a typical three-point harness used in baby products. If a patient wearing the device slides down in bed or otherwise needs to be repositioned, the mattress 70 may be inflated and the patient slid upward, safely and easily. The transfer mattress 70 preferably includes an opening to allow an attendant to position a bed pan beneath the patient, if necessary or desired.

The patient transfer device 68 is shown open is FIG. 7A and closed in FIG. 7B. Depending on the condition and preference of the patient, the device 68 may be arranged in FIG. 7A underneath a patient and attached to the patient, as desired. Alternatively, the device may be arranged as shown in FIG. 7B allowing a patient to wear the device 68 like a pair of shorts. The device 68 may be attached to a patient mattress to assist in preventing the patient from sliding down in bed.

In FIG. 8, a second wearable embodiment of patient transfer device 100 is shown. Here, the device 100 comprises a transfer mattress 104 having a wrap 110 for moving the patient together with the mattress 104. When a patient is transferred, the wrap 110 may be worn as shown, the mattress 104 inflated, and the patient transferred from the bed to, for example, a chair. The wrap 110 is attached to the mattress 104 and, in the depicted embodiment, includes openings for the arms as shown. Arm movement may be restricted, if necessary, by leaving the patient's arms inside the wrap 110 or using a wrap 110 made without arm holes. For convenience, an air supply 120 may be attached directly to a chair 112 or any object into or onto which a patient will be transferred.

Figure 9A:
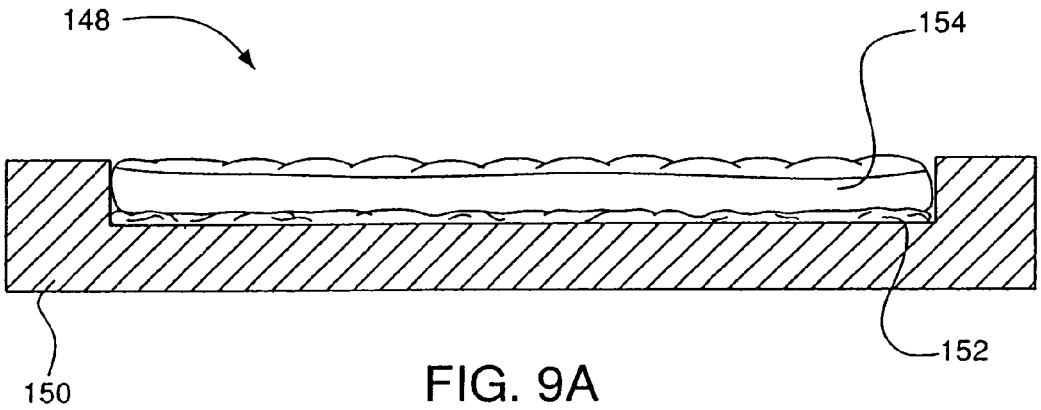
FIGS. 9A and 9B are a patient transfer device comprising a mattress having a recessed portion for receiving a patient transfer device, in accordance with an embodiment of the invention.
Figure 9B:
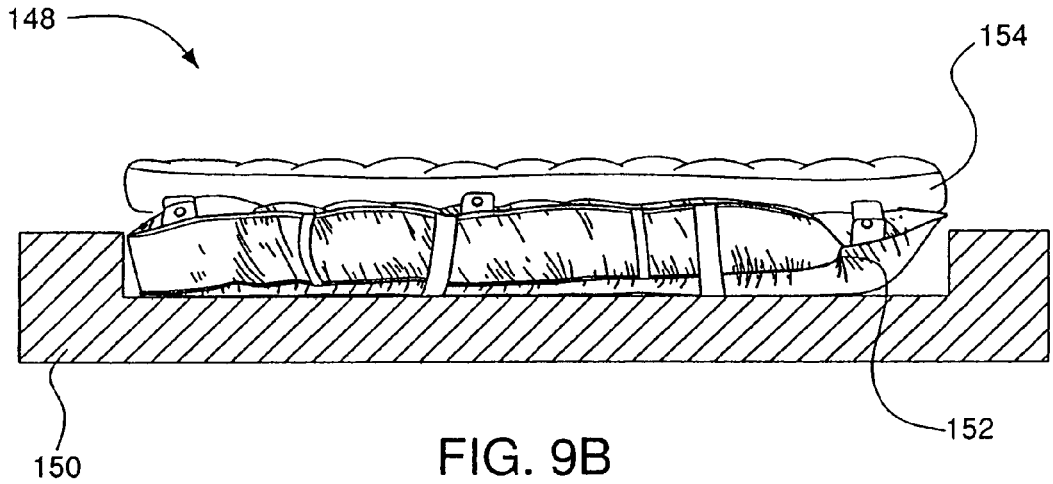

Referring now to FIGS. 9A and 9B, there is shown an embodiment of patient transfer device 148 comprising a patient mattress 150 having a recessed portion. In the depicted embodiment, the device includes a transfer mattress 152 with an inflatable mattress 154 attached to it. In FIG. 9A, the inflatable mattress 152 is deflated. The height of the inflatable mattress 154 is preferably approximately equivalent to the height of the recess. To transfer a patient, the transfer mattress 152 may be inflated as shown in FIG. 9B and transferred to another supporting surface. The width of the recessed portion may be equal to or less than the width of the patient mattress 150. Where the width of the recessed portion is less, the longitudinal edges of the mattress 150 may be removable or hingedly attached.

Figure 10:
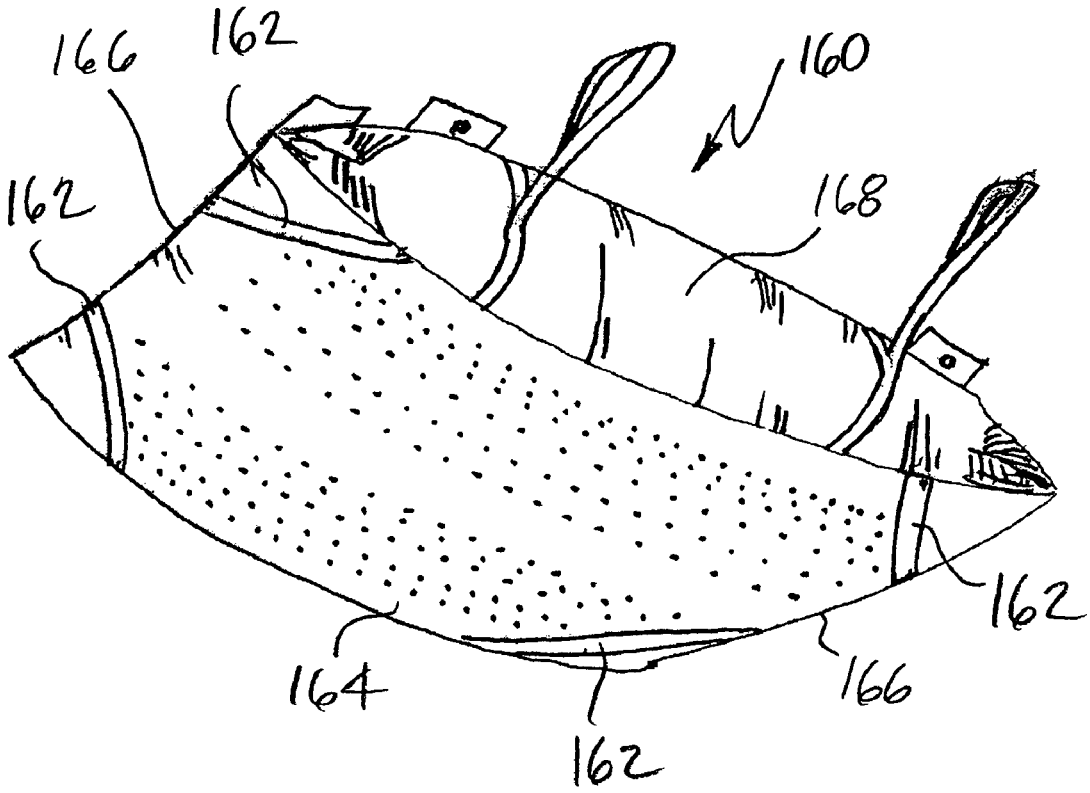
FIG. 10 is a patient transfer mattress including a pair of corner straps for engagement between the mattress and a mattress support member to limit relative movement between the mattress and the mattress support member.

Referring to FIG. 10, there is shown a patient transfer mattress 160 according to the invention having corner straps 162 for engagement with a support member for the transfer mattress 160, such as a gurney or examination table for example. The engagement between the corner straps 162 and the mattress support member limits relative movement between the transfer mattress 160 and the mattress support member. Limiting the relative movement in this manner serves to prevent the transfer mattress 160 from becoming bunched toward one end of the mattress support member, particularly when the transfer mattress is in a deflated condition.

Preferably, the transfer mattress 160 includes pairs of corner straps 162 located at each end of the mattress 160 to provide for engagement between the mattress 160 and an underlying support member at each end of the mattress 160. It is not a requirement, however, that a transfer mattress include corner straps 162 at each end of the transfer mattress. A sectioned mattress, such as shown in FIGS. 5 and 6 having multiple segments adapted for connection in an end-to-end manner, could include corner straps 162 at one end of each of the segments. In this manner, the mattress segments of the sectioned mattress could be arranged such that a completed transfer mattress includes corner straps at each end of the mattress.

The corner straps 162 are preferably made from a flexible material, such as an elastic for example, to facilitate placement of the corner straps 162 into engagement with an underlying mattress support member such as a gurney. The use of an elastic material for corner straps 162 also facilitates engagement between a particularly constructed corner strap 162 and different support members of various dimensions. As shown each of the corner straps 162 is secured at its ends, preferably by stitching the strap 162, to the transfer mattress 160. The strap 162 is preferably secured to the mattress 160 such that its ends are adjacent to the periphery of the transfer mattress 160. This construction for corner straps 162 is similar to corner straps provided for mattress pads for beds, which are adapted for placement over the corners of a mattress to secure the mattress pad to the underlying mattress and prevent the mattress pad from becoming bunched towards one end of the mattress.

In the transfer mattress 160 shown in FIG. 10, the anti-bunching corner straps 162 are secured to the transfer mattress 160 near the periphery of the bottom sheet 164 such that the straps 162 are located on the bottom surface of the transfer mattress 160. This places the corner straps on the mattress 160 on that surface of the mattress 160 that is closest to the mattress support member on which the mattress 160 is received. This arrangement facilitates the engagement between the corner straps 162 and the mattress support member. It is not required by the invention however, that the corner straps 162 be located on the bottom of the transfer mattress 160. It is within the scope of the invention, for example, to locate the corner straps on the upper surface of the transfer mattress 160 such that the corner straps 162 would be wrapped about the adjacent corner of the transfer mattress 160 to engage an underlying mattress support member. As shown each of the corner straps 162 extends across one of the corners of the bottom surface of transfer mattress 160 between an end 166 of the transfer mattress 160 and a side panel 168 of the transfer mattress.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A method of moving a patient on a support surface comprising the steps of:

providing an inflatable patient transfer mattress including holes in a bottom surface for creating a cushion of escaping air beneath the mattress to facilitate sliding of the mattress on a support surface, the mattress including at least a first inflatable segment and a second inflatable segment, the segments adapted for releasable attachment to each other such that the segments are arranged in an end-to-end fashion, the first segment having opposite first and second ends;

attaching the second segment to the first segment at the first end of the first segment;

placing the transfer mattress on the support surface such that the first segment is located at a first location on the support surface;

positioning a patient on the mattress such that at least a portion of the patient is supported on the first segment;

inflating at the least the first segment of the mattress;

sliding the mattress on the support surface while the patient is supported on the transfer mattress such that the first segment is moved from the first location on the support surface to a second location on the support surface;

separating the second segment from the first end of the first segment while the patient remains supported on the first segment;

rearranging the second segment with respect to the first segment to position the second segment at the second end of the first segment such that a portion of the patient is supported on each segment of the mattress; and attaching the second segment to the second end of the first segment.

2. The method of claim 1, wherein each of the mattress segments includes an inlet for receiving air from an air source for inflating the segment.

3. The method of claim 1, wherein each of the mattress segments includes opposite ends and at least one attachment member adjacent each end of the segment adapted for engagement with an attachment member of another segment.

4. The method of claim 3, wherein the attachment members comprise snap fasteners.

5. The method of claim 1, wherein each segment includes at least one elastic strap secured to the segment to extend along a bottom surface of the segment in a corner portion of the segment, the elastic strap adapted for engagement with an underlying support member to limit relative movement between the segment and the support member.

6. The method of claim 1, wherein the second segment is located at the second location on the support surface prior to the step of sliding the mattress.

7. The method of claim 1, wherein at least a portion of the patient is supported on the second segment prior to the step of sliding the mattress.

8. The method of claim 7, wherein the head and shoulders of the patient are located on the second segment prior to the step of sliding the mattress, and wherein the legs of the patient are located on the second segment following the steps of separating the second segment from the first segment and arranging the second segment with respect to the first segment.

9. The method of claim 1, wherein each segment of the mattress includes accessory fasteners located about a periphery of the segment for attaching an accessory to the segment.

10. The method of claim 9, wherein the accessory fasteners are located on mounting tabs located adjacent an upper surface of the segment.

11. A method of repositioning a patient on a support surface comprising the steps of:

providing an inflatable transfer mattress having holes in a bottom surface of the mattress to create a weight-bearing cushion of escaping air beneath the mattress to facilitate sliding of the mattress, the mattress including a first inflatable segment and a second inflatable segment, the first segment having opposite first and second ends;

placing the mattress on a support surface;

positioning a patient on the mattress such that a portion of the patient is supported on the first segment and at least the head of the patient is supported on the second segment;

inflating the first and second segments;

sliding the transfer mattress on the support surface;

removing the second segment from the first end of the first segment while the patient remains supported on the first segment and rearranging the second segment with respect to the first segment at the opposite second end of the first segment such that the legs of the patient are located on the second segment; and attaching the second segment to the first segment at the second end of the first segment.

12. A method of relocating a patient on a support surface comprising the steps of:

providing an inflatable transfer mattress including holes in a bottom surface to create a cushion of escaping air beneath the mattress to facilitate sliding movement of the mattress, the mattress including an inflatable first segment and an inflatable second segment adapted for attachment to each other such that the segments are arranged in end-to-end fashion, the first segment including a first end and an opposite second end;

attaching the second segment to the first end of the first segment;

placing the mattress on a support surface such that the first segment is located on a first portion of the support surface;

positioning a patient on the mattress such that at least a portion of the patient is supported on the first segment;

inflating the mattress;

sliding the mattress and patient on the support surface such that the first segment is moved from the first portion of the support surface to a second portion of the support surface;

removing the second segment from the first end of the first segment while the patient remains supported on the first segment;

rearranging the second segment with respect to the first segment at the second end of the first segment: and attaching the second segment to the second end of the first segment.

13. The method of claim 12, wherein the head and shoulders of the patient are located on the second segment prior to the step of sliding the mattress, and wherein the legs of the patient are located on the second segment following the steps of removing the second segment from the first end of the first segment and rearranging the second segment with respect to the first segment at the second end of the first segment.

* * * * *